US010094058B2

(12) United States Patent
Hofemeister et al.

(10) Patent No.: US 10,094,058 B2
(45) Date of Patent: Oct. 9, 2018

(54) METHOD AND APPARATUS FOR GUIDING A NONWOVEN WEB

(71) Applicant: Reifenhaeuser GmbH & Co.KG Maschinenfabrik, Troisdorf (DE)

(72) Inventors: Hans-Juergen Hofemeister, Troisdorf-Spich (DE); Hans-Georg Geus, Niederkassel (DE); Felix Goretzki, Ense Bremen (DE); Alexander Klein, Troisdorf (DE); Michael Nitschke, Koenigswinter (DE); Detlef Frey, Niederkassel (DE); Martin Neuenhofer, Cologne (DE)

(73) Assignee: REIFENHAEUSER GMBH & CO. KG MASCHINENFABRIK, Troisdorf (DE)

( * ) Notice: Subject to any disclaimer, the term of this patent is extended or adjusted under 35 U.S.C. 154(b) by 52 days.

(21) Appl. No.: 15/009,106

(22) Filed: Jan. 28, 2016

(65) Prior Publication Data

US 2016/0222558 A1 Aug. 4, 2016

(30) Foreign Application Priority Data

Jan. 30, 2015 (EP) ..... 15153315

(51) Int. Cl.
*D06C 29/00* (2006.01)
*D06C 15/08* (2006.01)
(Continued)

(52) U.S. Cl.
CPC ..... *D06C 29/00* (2013.01); *D04H 1/44* (2013.01); *D04H 3/02* (2013.01); *D04H 3/14* (2013.01); *D06C 15/02* (2013.01); *D06C 15/08* (2013.01)

(58) Field of Classification Search
CPC .. D06C 7/00; D06C 2700/26; D06C 2700/17; D06C 15/00; D06C 15/10; D06C 15/08;
(Continued)

(56) References Cited

U.S. PATENT DOCUMENTS 1,797,398 A * 3/1931 Bosshard ..... D06C 15/00 38/144
1,861,422 A * 5/1932 Cluett ..... D06C 21/00 162/361
2,233,274 A * 2/1941 Teague ..... B29C 70/00 28/156
2,495,053 A * 1/1950 Conaway ..... F26B 13/001 28/219

(Continued)

FOREIGN PATENT DOCUMENTS

DE 9408597 U 11/1995

OTHER PUBLICATIONS

English language machine translation of DE 9408597 (pub. Sep. 1995), description and claims, 8 pages.*

*Primary Examiner* — Amy Vanatta
(74) *Attorney, Agent, or Firm* — Andrew Wilford

(57) ABSTRACT

A nonwoven web made of plastic fibers and having a web thickness less than 2 mm (preferably less than 1.5 mm) and a grammage less than 30 g/m$^2$ (preferably less than 25 g/m$^2$) and conveyed this web in a travel direction so that it physically contacts a guide or treatment roller. A stabilization plate extending in and transversely to the travel direction of the nonwoven web is provided upstream or downstream of the roller in the travel direction, and the nonwoven web is guided in the travel direction past the stabilization plate such that a spacing between a face of the stabilization plate turned toward the nonwoven web and the nonwoven web face is 0 to 20 mm (preferably 0.1 to 10 mm, and very preferably 0.2 to 5 mm).

15 Claims, 3 Drawing Sheets

(51) Int. Cl.

| | |
|---|---|
| ***D06C 15/02*** | (2006.01) |
| ***D04H 3/02*** | (2006.01) |
| ***D04H 3/14*** | (2012.01) |
| ***D04H 1/44*** | (2006.01) |

(58) Field of Classification Search

CPC ..... D06C 15/02; D06C 21/00; D04H 1/44; D04H 3/02; D04H 3/14; B65H 29/52; B65H 20/00; B65H 20/12; B65H 20/14; B65H 29/24; F26B 13/104; F26B 13/10; F26B 13/101; F26B 13/103; F26B 17/00; F26B 3/04; F26B 17/10; F26B 17/106; F26B 7/1441; F26B 17/1451

USPC ..... 26/18.5, 18.6; 34/359, 360, 367, 369, 34/460, 462, 576, 580, 588, 640

See application file for complete search history.

(56) References Cited

U.S. PATENT DOCUMENTS

| | | | | |
|---|---|---|---|---|
| 2,753,591 | A * | 7/1956 | Stevens | B29B 13/023 101/22 |
| 3,616,634 | A * | 11/1971 | Tomita | D01D 5/22 264/172.14 |
| 3,646,188 | A * | 2/1972 | Campbell | B29C 71/02 26/106 |
| 4,088,731 | A * | 5/1978 | Groome | D04H 1/00 26/18.6 |
| 5,158,641 | A * | 10/1992 | Vermeulen | B30B 15/062 100/302 |
| 8,585,387 | B2 | 11/2013 | Oyamada | |
| 2009/0031542 | A1 * | 2/2009 | Marchesi | D06C 15/10 26/18.6 |

* cited by examiner

Fig. 1 - Prior Art
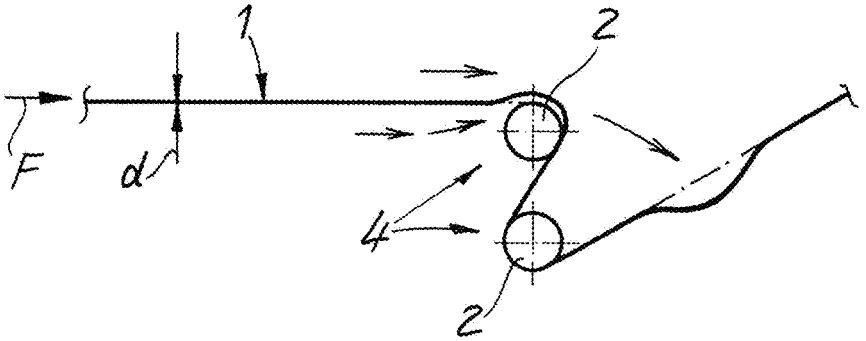
Fig. 2
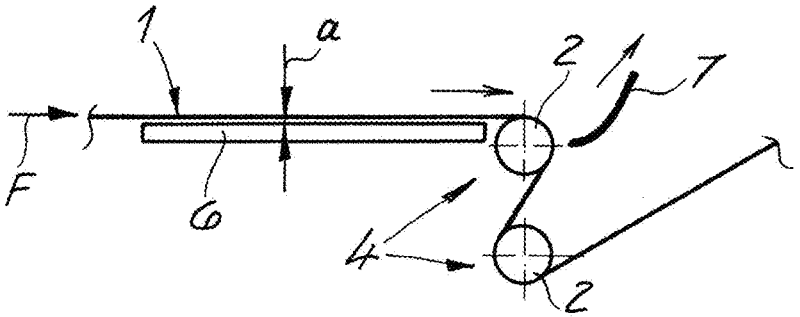
Fig. 3
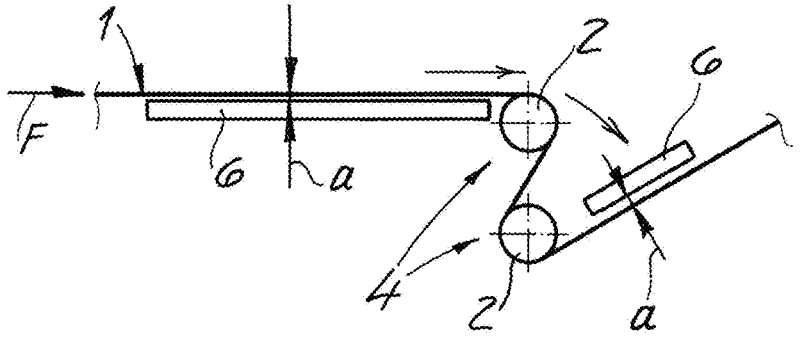

METHOD AND APPARATUS FOR GUIDING A NONWOVEN WEB

FIELD OF THE INVENTION

The present invention relates to the handling of a nonwoven web during its manufacture and use. More particularly this invention concerns a method and apparatus for guiding a nonwoven web made of plastic fibers.

BACKGROUND OF THE INVENTION

During manufacture, a nonwoven web is generally guided via guide and/or treatment rollers after the plastic fibers have been deposited to form the nonwoven web. The treatment rollers may be, for example, pinch rollers for compacting the nonwoven web or calender rollers for calendering the nonwoven web.

A method and apparatus of the above-described type is known in various embodiments from the prior art. When a nonwoven web is conveyed with a deposition screen belt and/or by guide rollers and/or treatment rollers, a flow of air that moves in the travel direction of the nonwoven web is produced at all times. With respect to the nonwoven webs, this flow of air leads to a poor operational performance, especially in the region of the guide rollers and/or treatment rollers between the deposition screen belt and a windup device. The operational performance is also adversely affected at the deposition screen belt and in the region of the winder. The poor operational performance results in a fluttering of the nonwoven web that may result in tearing or undesired wrinkling in the nonwoven web. Attempts to compensate for these disturbances use higher web tension order to control the nonwoven web. This higher web tension results in turn in a smaller width of the nonwoven web on the winder, as well as deteriorated properties of the nonwoven web, especially a lower resistance or tensile strength of the nonwoven web transversely to the machine direction (in the CD direction). The air entrained by the nonwoven web can also be problematic when the nonwoven web travels around a guide roller and/or a treatment roller. This can lead to an undesired floating of the nonwoven web on the roller; in addition, a flow of air may be directed out from a roller onto the nonwoven web face, causing the product to have undesired non-homogeneous properties.

In order to counter the above-described negative properties, it is already known from the prior art to incorporate additional rollers (guide rollers or deflection rollers) into the conveyance path of the nonwoven web. Other guiding elements, such as curved rods or the like, have also already been used. These measures not only are complex and expensive, but also have often failed to produce the desired results. It is furthermore already known to incorporate so-called spoiler sheets into the conveyance path of the nonwoven web, in order to divert air currents. Here, too, satisfactory results have generally not been achieved thus far.

OBJECTS OF THE INVENTION

It is therefore an object of the present invention to provide an improved method for guiding a nonwoven web.

Another object is the provision of such an improved method for guiding a nonwoven web that overcomes the above-given disadvantages, in particular with which the disadvantages described above can be effectively avoided.

The invention also has the object of providing a corresponding nonwoven-web guide assembly.

SUMMARY OF THE INVENTION

A nonwoven web made of plastic fibers and having a web thickness less than 2 mm (preferably less than 1.5 mm) and a grammage less than 30 g/m$^2$ (preferably less than 25 g/m$^2$) and conveying this web in a travel direction so that it physically contacts a guide or treatment roller. A stabilization plate extending in and transversely to the travel direction of the nonwoven web is provided upstream or downstream of the roller in the travel direction, and the nonwoven web is guided in the travel direction past the stabilization plate such that a spacing between a face of the stabilization plate turned toward the nonwoven web and the nonwoven web face is 0 to 20 mm (preferably 0.1 to 10 mm, and very preferably 0.2 to 5 mm). The spacing of the web from the plate is preferably 0.1 to 4 mm and particularly preferably is 0.1 to 3 mm.

According to a particularly preferred embodiment of the invention, the length of the stabilization plate measured in the travel direction of the nonwoven web is greater than the radius and preferably greater than the diameter of a roller immediately downstream of the stabilization plate in the travel direction and/or a roller immediately upstream of the stabilization plate in the travel direction. According to a very recommended embodiment, the length of the stabilization plate—as measured in the travel direction of the nonwoven web is greater than the radius and preferably greater than the diameter of the rollers of a roller assembly immediately downstream of the stabilization plate in the travel direction and/or the rollers of a roller assembly immediately upstream of the stabilization plate in the travel direction.

Advantageously, the length of the stabilization plate measured in the travel direction of the nonwoven web is at least 1.5 times, preferably at least 1.75 times, and very preferably at least 2 times the radius of the at least one downstream roller and/or upstream roller. The above-mentioned rollers having the stated radius and/or having the stated diameter are in particular to guide rollers for deflecting the nonwoven web such that the nonwoven web is advantageously deflected by such a guide roller by an angle of at least 50°, preferably at least 70°, and preferably at least 90°, or are at least one treatment roller, preferably for compacting and/or calendering the nonwoven web. According to recommendation, the treatment roller is a component of a roller assembly having at least two treatment rollers and these treatment rollers are provided such that the traveling nonwoven web passes the two treatment rollers through a treatment gap (treatment nip) therebetween.

A particularly preferred embodiment of the invention is characterized in that at least one stabilization plate extending in and transversely to the travel direction of the nonwoven web or the face of the stabilization plate turned toward the nonwoven web is provided parallel to the nonwoven web or to the nonwoven web face or substantially parallel to the nonwoven web/to the nonwoven web face.

According to a particularly recommended embodiment of the invention, a nonwoven web having a grammage of less than 20 g/m$^2$, preferably less than 15 g/m$^2$, and preferably less than 10 g/m$^2$ is conveyed. With a grammage of under 20 g/m$^2$, especially a grammage under 15 g/m$^2$, and most especially a grammage of under 10 g/m$^2$, the invention has proven very special. Within the scope of the invention, a nonwoven web is a nonwoven web consisting solely of deposited filaments or also a nonwoven web laminate made of a plurality of deposited layers of filaments.

A particularly recommended embodiment, which has special significance within the scope of the invention, is characterized in that the fibers are plastic continuous filaments. Nonwoven webs made of continuous filaments are characterized by very special aerodynamic properties, and differ significantly in this respect from nonwoven webs made of short fibers. Advantageously, plastic fibers or plastic continuous filaments made of thermoplastic material are used within the scope of the invention.

A preferred embodiment of the method according to the invention is characterized in that at least one spunbond nonwoven web and/or at least one melt-blown nonwoven web is used as the nonwoven web. These types of nonwoven webs have proven particularly suitable in the scope of the method according to the invention and in the nonwoven-web guide assembly according to the invention. Spunbond nonwoven webs and/or melt-blown nonwoven webs are characterized by special properties in air supply or aerodynamic manipulation, and may be conveyed in a particularly functionally reliable and disturbance-free manner in the scope of the method according to the invention or with the nonwoven-web guide assembly according to the invention. According to one embodiment of the invention, the traveling nonwoven web corresponds to a laminate made of at least one spunbond nonwoven web and at least one melt-blown nonwoven web. Also particularly suitable is a laminate having the layering sequence spunbond nonwoven web/melt-blown nonwoven web/spunbond nonwoven web (an SMS laminate).

According to a recommended embodiment of the invention, at least one stabilization plate is provided upstream of a roller or upstream of a roller assembly in the travel direction. It is then within the scope of the invention that the nonwoven web is guided freely or substantially freely upstream of the roller or upstream of the roller assembly in the travel direction via an upstream conveyor section, and at least one stabilization plate is spacedly or immediately upstream of the roller or the roller assembly in this upstream conveyor section. Free guidance of the nonwoven web signifies here and hereinafter that the nonwoven web is not guided/treated by rollers or roller assemblies in this conveyor section, and also advantageously is not guided by a deposition device or by a deposition screen belt. In the above-described embodiment, the at least one stabilization plate may be provided beneath and/or above the nonwoven web. A stabilization plate beneath the nonwoven web means that the spacing is measured between the upper face of the stabilization plate and the lower face of the nonwoven web, and a stabilization plate above the nonwoven web means that the spacing is measured between the lower face of the stabilization plate and the upper face of the nonwoven web.

According to another preferred embodiment of the invention, the nonwoven web is conveyed freely or substantially free downstream of a roller or downstream of a roller assembly in the travel direction via a second conveyor section in which at least one stabilization plate is positioned spacedly or immediately downstream of the roller or the roller assembly. The at least one stabilization plate may then be positioned beneath the nonwoven web and/or above the nonwoven web.

It is within the scope of the invention that the nonwoven web is guided free or substantially freely upstream of a roller or upstream of a roller assembly in the travel direction via an upstream conveyor section, that at least one stabilization plate is provided at a spacing upstream of or directly upstream of the roller or the roller assembly in this upstream conveyor section, that the nonwoven web is conveyed free or substantially free downstream of the roller or the roller assembly in the travel direction via a second conveyor section, and that at least one stabilization plate is positioned spacedly or immediately downstream of the roller or the roller assembly in this second conveyor section.

A roller assembly within the scope of the invention is formed by at least two rollers whose axes are one above the other. They may be guide and/or treatment rollers. According to a recommended embodiment of the invention, a roller assembly comprises two rollers provided above the other so as to be spaced apart from one another; advantageously, the nonwoven web is guided by an S-shaped approach over or through this roller assembly (in the sense of an S-shaped take-off roller). The nonwoven web may then first be guided through the upper roller of the roller assembly or first guided past the lower roller of the roller assembly. According to a preferred embodiment, the nonwoven web is guided first via the upper roller of the roller assembly and then around the lower roller of the roller assembly.

According to a first embodiment, at least one or one stabilization plate is provided beneath the guided or freely guided nonwoven web spacedly or immediately upstream of the above-described roller assembly (S-roller assembly) in the upstream conveyor section. Preferably, at least one flat deflection element for deflecting the air entrained on the face of the guided nonwoven web is provided downstream of this roller assembly and particularly preferably immediately downstream of the upper roller of this roller assembly in the travel direction. Then, the flat deflection element preferably upwardly deflects the air entrained by the nonwoven web upper face.

A variant of the above-described first embodiment is characterized in that in addition to the stabilization plate upstream of the roller assembly (S-roller assembly) and beneath the nonwoven web, at least one additional stabilization plate or one additional stabilization plate is provided spacedly or immediately downstream of the roller assembly in a second conveyor section. This stabilization plate may then be provided above the traveling nonwoven web or below the traveling nonwoven web. In both cases, the nonwoven web, which continues to be conveyed downstream of the roller assembly, is stabilized in terms of air flow effects, which result from air conveyed over the roller assembly with the nonwoven web.

A second embodiment of the invention is characterized in that at least one stabilization plate or one stabilization plate is provided above the nonwoven web spacedly or immediately upstream of the above-described roller assembly (S-roller assembly) in the upstream conveyor section. Advantageously, in this embodiment, at least one flat deflection element is provided below the nonwoven web and preferably also under the above-described stabilization plate. According to recommendation, this at least one flat deflection element is provided below the nonwoven web or below the stabilization plate at the downstream end of the stabilization plate in the travel direction. It is within the scope of the invention that with this flat deflection element, air entrained by the lower face of the nonwoven web is deflected, and indeed advantageously deflected downward away from the nonwoven web. For this purpose, the flat deflection element is preferably bent, and the bend advantageously extends downward away from the lower face of the nonwoven web.

Another successful embodiment of the invention is characterized in that at least and preferably two treatment rollers are provided preferably with the axes thereof immediately above one another, and in that a narrow treatment gap (so-called nip) is formed between the two treatment rollers. The nonwoven web is guided through this treatment gap (nip) and preferably the two treatment rollers then apply pressure to the nonwoven web, both from above and from below. According to need, the treatment rollers are pinch rollers or calender rollers. The assembly made of the at least two treatment rollers is designated here and here below as a treatment roller assembly. Such a treatment roller assembly thus advantageously has a treatment gap or nip through which the traveling nonwoven web is guided.

A first embodiment of the invention, which comprises this treatment assembly, is characterized in that at least and preferably one stabilization plate is at a spacing upstream or immediately upstream of the roller assembly in the travel direction of the nonwoven web, and according to a recommended embodiment is positioned above the nonwoven web. Then, according to a variant, the nonwoven web can also be supported on a deposition device or on a deposition screen belt instead of being freely guided, and the stabilization plate is advantageously provided above the deposition device or above the deposition screen belt such that the traveling nonwoven web is located between the deposition device or deposition screen belt and the stabilization plate provided thereabove. The stabilization plate is positioned above the traveling nonwoven web with a spacing.

A second embodiment of the invention that comprises the treatment roller assembly is characterized in that a stabilization plate is provided above the nonwoven web and another stabilization plate is provided below the nonwoven web spacedly or immediately upstream of the treatment roller assembly in the travel direction of the nonwoven web. The traveling nonwoven web is then at least partially guided through a clearance gap between the stabilization plate provided below the nonwoven web and the stabilization plate positioned above the nonwoven web. It is within the scope of the invention that in these embodiments, the ends of the stabilization plates are aligned or are substantially aligned in the vertical direction. However, the stabilization plates can be slightly displaced or offset. The stabilization plates provided above and below the nonwoven web make it possible to reduce or, in some regions where there is no interference, divert the flow of air caused by movement of the nonwoven web.

According to one embodiment of the invention, one stabilization plate has a plurality of grooves at a face thereof turned toward the nonwoven web, and the grooves may be at least partially aligned parallel to one another according to one embodiment. The grooves may also be provided, for example, in a herringbone pattern. These grooves provided in the face of the stabilization plate make it possible to reduce the frictional forces between the moving nonwoven web and the preferably non-moving stabilization plate. The grooves make it possible to divert away air currents or air layers resulting from the movement of the nonwoven web. One embodiment of the invention is characterized in that openings or pressure equalization openings are provided in a stabilization plate. These openings or pressure equalization openings may be positioned near or in the grooves. It is possible for air to be suctioned out of the intermediate region between the nonwoven web and the stabilization plate via the pressure equalization openings. It is within the scope of the invention that the air currents between nonwoven web and stabilization plate can be adjusted or influenced in an advantageous manner through the number and arrangement of the grooves and/or through the number and arrangement of the pressure equalization openings.

It has already been noted above that according to a preferred embodiment of the invention, there is at least one additional stabilization element, except when using only one stabilization plate, and the stabilization element is advantageously configured as a flat deflection element. Such a flat deflection element makes it possible for air that has been entrained on the nonwoven web face by the traveling nonwoven web to be diverted or deflected away from the nonwoven web face in an effective manner. The flat deflection element is advantageously configured as a flat baffle. Such a flat deflection element is provided above and/or below the traveling nonwoven web, such that air entrained by the nonwoven web upper face and/or air entrained by the nonwoven web lower face can be deflected away from the nonwoven web upper face with the aid of the flat deflection element or flat baffle. Examples thereof shall be described in greater detail in the description of the drawings.

According to a preferred embodiment of the method according to the invention, the traveling nonwoven web is conveyed at a travel speed greater than 600 m/min, preferably greater than 700 m/min, and especially preferably greater than 750 m/min. It is within the scope of the invention that the traveling nonwoven web is conveyed so as to be free of gas pressurization and thus free of both air pressurization and steam pressurization in the region of a stabilization plate or in the region of at least one stabilization plate. Advantageously, therefore, the nonwoven web is not deliberately or artificially pressurized with a gas, and thus with neither air nor steam.

The present invention also relates to a nonwoven-web guide assembly for guiding a nonwoven web made of plastic fibers preferably of plastic continuous filaments—conveyed in a travel direction, comprising at least one supply device for the traveling nonwoven web, at least one guide roller and/or treatment roller for the nonwoven web or at least one roller assembly made of at least two guide and/or treatment rollers (rollers) for the nonwoven web is/are provided downstream of the supply device in the travel direction of the nonwoven web, at least one stabilization plate extending in and transversely to the travel direction of the nonwoven web or immediately upstream of the roller or the roller assembly in the travel direction and/or spacedly or immediately downstream of the roller or the roller assembly in the travel direction, the at least one stabilization plate being positioned such that a spacing between the face of the stabilization plate turned toward the nonwoven web and the nonwoven web upper face is 0 to 20 mm, preferably 0.1 to 10 mm, very preferably 0.2 to 5 mm, and especially preferably 0.2 to 3 mm.

According to a recommended embodiment, the shortest spacing between the roller-side end of a stabilization plate provided upstream of the roller or upstream of the roller assembly in the travel direction and the roller downstream of the stabilization plate in the travel direction or a furthest upstream roller is 0.2 to 500 mm, preferably 0.2 to 200 mm, preferably 0.2 to 100 mm, and especially preferably 0.2 to 50 mm. According to one embodiment, the spacing $a_1$ amounts to 0.2 to 40 mm.

According to recommendation, alternatively or additionally to this embodiment, the shortest spacing between the roller-side end of a stabilization plate provided downstream of the roller or downstream of the roller assembly in the travel direction and the roller upstream of the stabilization plate in the travel direction or the furthest downstream roller of the roller assembly is 0.2 to 500 mm, preferably 0.2 to 150 mm, preferably 0.2 to 100 mm.

The supply device for supplying the nonwoven web used within the scope of the invention may be, for example, a conveyor belt, a conveyor-type deposition screen belt, or another deposition device that conveys the nonwoven web in the travel direction. Fundamentally, however, any device that can move the nonwoven web in the travel direction can be used.

It is within the scope of the invention that a roller assembly made of at least two guide rollers is provided and the two guide rollers are positioned such that the traveling nonwoven web is guided first over an upper guide roller and then guided to a lower guide roller below the upper roller. Fundamentally, the guiding may also be reversed, i.e. the traveling nonwoven web passes first around the lower guide roller and then around the upper guide roller.

According to another embodiment already set forth above, the roller assembly comprises at least two treatment rollers that are positioned such that the traveling nonwoven web passes through a treatment gap (nip or treatment nip) between the two treatment rollers.

A preferred embodiment of the guide assembly according to the invention is characterized in that the at least one stabilization plate is stationary. Within the scope of the invention, this means that the at least one stabilization plate or stabilization plates is/are fixed during operation of the guide assembly, and is/are not relocated or moved away from this position. On the other hand, however, it is also within the scope of the invention that the at least one stabilization plate or the stabilization plates can be adjusted or finely calibrated with respect to the position thereof, especially when the guide assembly is not operating.

It has already been noted that according to a proven embodiment of the invention, in addition to the at least one stabilization plate, at least one stabilization element is configured, as a flat deflection element, preferably as a flat baffle. According to recommendation, the flat deflection element or the baffle comprises a deflection tongue provided at a short spacing u from the nonwoven web upper face such that air entrained on the nonwoven web upper face by the nonwoven web is deflected or diverted from the nonwoven web upper face via the flat deflection element.

The invention is based on the discovery that with the method according to the invention or the nonwoven-web guide assembly according to the invention, nonwoven webs can be guided in an optimal, functionally reliable, and disturbance-free manner, and indeed even nonwoven webs that have a small thickness and low grammage can be thus guided. The disturbing influence of air currents can be greatly reduced or minimized with the aid of the guidance means according to the invention, such that an undesired fluttering of the nonwoven web no longer occurs or occurs only negligibly. Overall, the operational performance of the moving nonwoven web can be remarkably improved as compared to many known methods and guide assemblies. Undesirably high web tension is not needed, such that any undesired reductions in the nonwoven web width and undesired reductions in the strength of the nonwoven web in the transverse direction, which would result therefrom, will also not occur. It should be emphasized that the object according to the invention can be attained with relatively simple and inexpensive measures, and indeed surprisingly effectively and functionally reliably so.

BRIEF DESCRIPTION OF THE DRAWING

The above and other objects, features, and advantages will become more readily apparent from the following description, reference being made to the accompanying drawing in which:

FIG. 1 is a schematic view of a nonwoven-web guide assembly according to the prior art;

FIG. 2 is a schematic view of a first embodiment of a nonwoven-web guide assembly according to the invention;

FIG. 3 is a schematic view of a second embodiment as in FIG. 2;

SPECIFIC DESCRIPTION OF THE INVENTION

As seen in FIG. 1 a prior-art nonwoven-web guide assembly according to the invention carries out a method according to the invention of guiding a nonwoven web 1 made of plastic fibers conveyed in a travel direction F. The plastic fibers—preferably and in the embodiment—are continuous plastic filaments advantageously composed of a thermoplastic. Such a web is typically made by depositing the filaments forming the web on an upper reach of a horizontally extending foraminous web through which air is drawn downward. The deposited filaments are compressed into the coherent web 1.

In the embodiment according to the drawings, the nonwoven web 1 may be a spunbond nonwoven web. In particular, it is within the scope of the invention to use a nonwoven web laminate as the nonwoven web, where the laminate preferably comprises at least one spunbond nonwoven web and one melt-blown nonwoven web; particularly preferably is a laminate having a layering sequence of spunbond nonwoven web/melt-blown nonwoven web/spunbond nonwoven web (SMS). It is within the scope of the invention that the nonwoven web 1 has a web thickness d of less than 2 mm, and preferably a grammage less than 20 $g/m^2$, particularly preferably less than 15 $g/m^2$.

Figure 6:
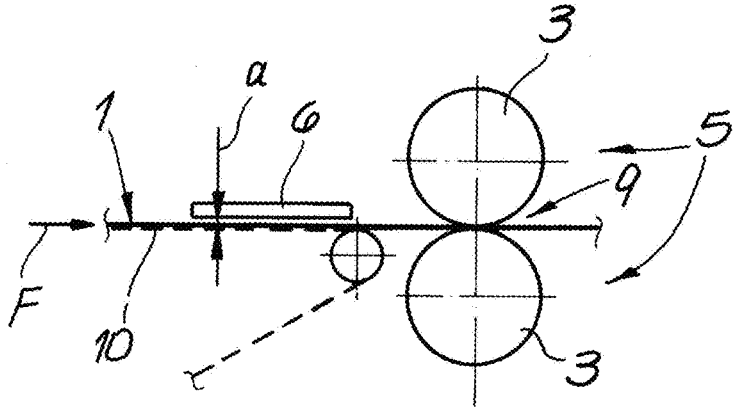
FIG. 6 is a schematic view of a first embodiment of a nonwoven-web guide assembly according to the invention having treatment rollers.
Figure 7:
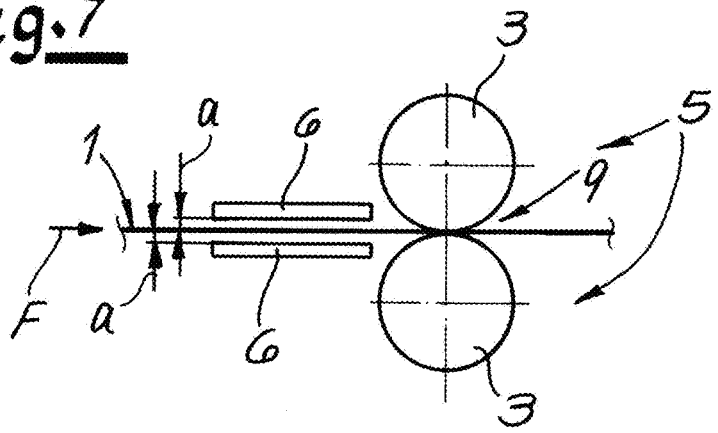
FIG. 7 is a schematic view of a second embodiment as in FIG. 6.
Figure 8:
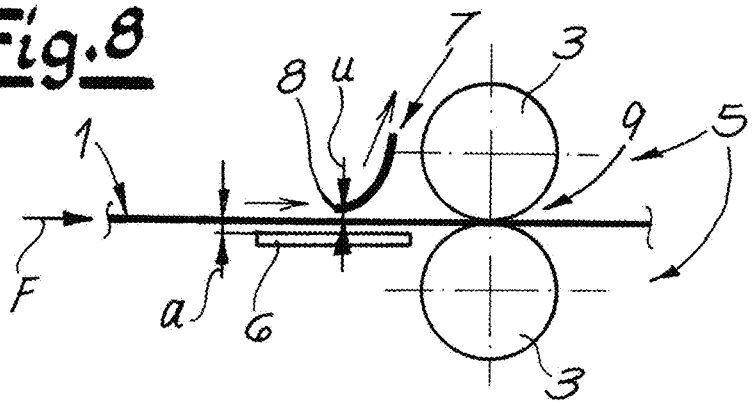
FIG. 8 is a schematic view of a third embodiment as in FIG. 6.

The nonwoven web 1 comes into physical contact with guide rollers 2 and/or treatment rollers 3 (FIGS. 6-8). FIG. 1 shows a guide roller assembly 4 that comprises a plurality of the guide rollers 2, preferably two. FIGS. 6-8 show a treatment assembly 5 comprised of a plurality of the treatment rollers 3, preferably two.

FIG. 1 shows a nonwoven-web guide assembly according to the prior art. Here, the nonwoven web 1 is guided only via the vertically spaced upper and lower guide rollers 2 of an S-shaped guide roller assembly 4. Air is then entrained on the nonwoven web upper faces 1 by of the nonwoven web 1. The air current resulting from the air entrained leads first to the nonwoven web 1 being lifted from the upper guide roller 2 as indicated in FIG. 1 and thus being guided in a functionally unreliable manner. In addition, the air entrained on the upper face of the nonwoven web 1 forms an air current downstream of the guide roller assembly 4 on a downstream section of the traveling nonwoven web 1 (right side of FIG. 1) and the nonwoven web 1 being then bunged out. These deformations may, due to the air currents, result in undesired nonhomogeneities in the nonwoven web 1 as well as necessitate a higher web tension for reliable guiding of the nonwoven web 1. Such higher web tension may result in an undesired reduction in the width of the nonwoven web 1.

FIGS. 2 to 5 illustrate a nonwoven-web guide assembly analogous to FIG. 1, having means or components according to the invention. In FIG. 2, the nonwoven web 1 is again passed through an S-shaped guide roller assembly 4 formed by upper and lower guide rollers 2 spaced one immediately above the other. A planar stabilization plate 6 extending in and transversely to the travel direction F of the nonwoven web 1 is provided at a spacing upstream or immediately upstream of the guide roller assembly 4 in the travel direction F or spacedly upstream/immediately upstream of the upper guide roller 2. In the embodiment according to FIG. 2, the stabilization plate 6 is below the nonwoven web 1 with its horizontal and planar upper face at a spacing a below the nonwoven web. The spacing a may be between 0.1 and 3 mm in this embodiment. The stabilization plate 6, which is below the nonwoven web 1 in FIG. 2, makes it possible to control air entrained by the lower face of the nonwoven web 1 in a functionally reliable manner.

In the embodiment in FIG. 2, a deflection plate 7 in the shape of a flat baffle is positioned downstream of the guide roller assembly 4 or downstream of the upper guide roller 2 of this guide roller assembly 4. This flat deflection plate 7 upwardly diverts air carried along on the upper face of the traveling nonwoven web 1, so that the air current is not present on the nonwoven web 1 further conveyed downstream of the guide roller assembly 4, as in the embodiment in FIG. 1. The flat deflection plate 7 is preferably and in this embodiment of arcuate shape, such that the air guided along with the nonwoven web 1 is deflected upward. Comparative observation of FIGS. 1 and 2 shows that with the measures according to the invention, the disturbing air influences or air currents that can be recognized in FIG. 1 can be effectively avoided.

FIG. 3 shows another embodiment of the nonwoven-web guide assembly according to the invention. Here, as in the embodiment of FIG. 2, a stabilization plate 6 is set at a spacing a below the nonwoven web 1 immediately upstream of the guide roller assembly 4 in the travel direction F. Instead of the flat deflection plate 7 in the embodiment according to FIG. 2, another stabilization plate 6 is set at a spacing a above the nonwoven web 1 immediately downstream of the guide roller assembly 4. The adverse effects, depicted on the right side of FIG. 1, of the air current entrained by the nonwoven web 1 and deflected via the upper guide roller 2 are also avoided due to the fact that the nonwoven web 1 downstream of the guide roller assembly 4 is shielded from this disadvantageous air current by the stabilization plate 6 positioned above the nonwoven web 1.

Figure 4:
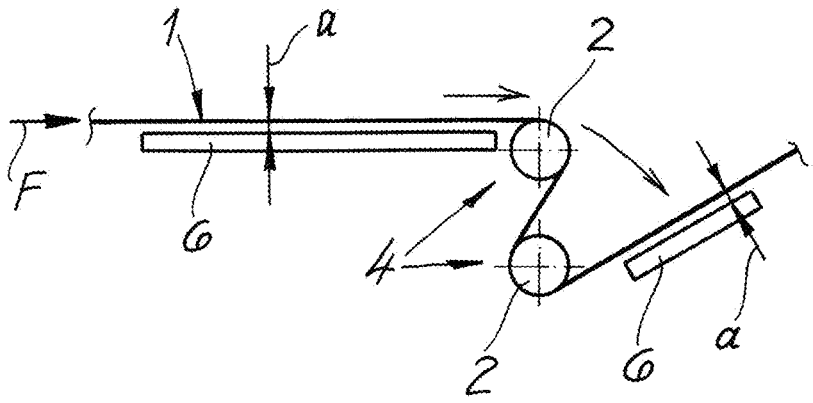
FIG. 4 is a schematic view of a third embodiment as in FIG. 2.

FIG. 4 shows an embodiment similar to FIG. 2. Here, however, the second stabilization plate 6 is set at a spacing a below the nonwoven web 1 immediately downstream of the guide roller assembly 4. The adverse effects of the above-described air current are still effectively avoided. The nonwoven web 1 can continue being guided over the second stabilization plate 6 in a more functionally reliable manner and without deformation as an air cushion trapped between the web 1 and the downstream or second stabilization plate 6 keeps the web 1 flat.

Figure 5:
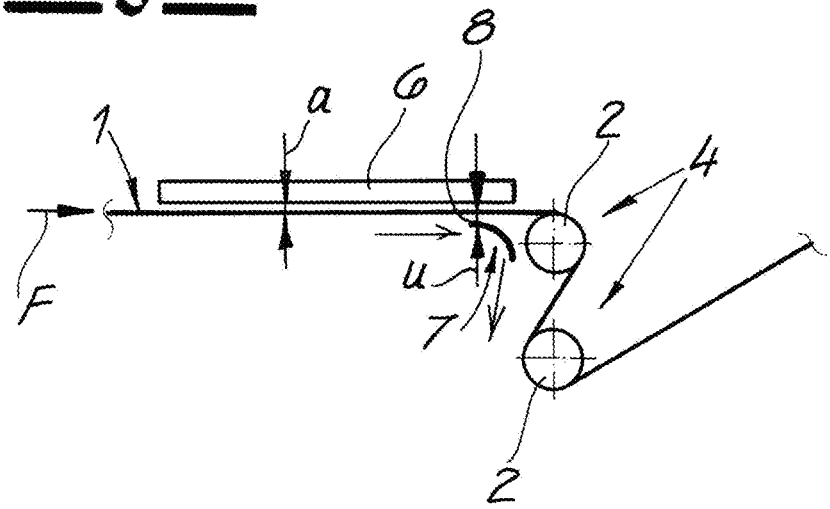
FIG. 5 is a schematic view of a fourth embodiment as in FIG. 2.

In the embodiment according to FIG. 5, a stabilization plate 6 at a spacing a above the nonwoven web 1 is positioned immediately upstream of the guide roller assembly 4, as seen in the travel direction F of the nonwoven web 1. This stabilization plate 7 provided above causes the air guided along on the upper face of the nonwoven web 1 to be unable to adversely affect or apply pressure as shown on the right of FIG. 1 to the nonwoven web 1 continuing to be guided downstream of the guide roller assembly 4. In order to avoid the adverse effects of the air guided along on the lower face of the nonwoven web 1, a flat deflection plate 7 is provided under the nonwoven web 1 immediately upstream of the guide roller assembly 4 such that air entrained on the lower face of the nonwoven web 1 is diverted away from the nonwoven web 1 by this flat deflection plate 7 and not trapped under the web 1 to bulge it upward as in FIG. 1. For this purpose, this flat deflection plate 7 has a deflection tongue or upstream edge 8 set at a small spacing u from the lower nonwoven web face, and the flat deflection plate 7 is bent downward coming out from this deflection tongue 8 so that it is concave toward the web 1 and downstream. The deflection tongue 8 effectively downwardly deflects or diverts the air entrained on the lower face of the nonwoven web 1 via the bending of the flat deflection plate 7. This effectively prevents the nonwoven web 1 from floating, as it were, above the upper guide roller 1 as shown in FIG. 1.

FIG. 6 shows another embodiment of the nonwoven-web guide assembly according to the invention. Here, the traveling nonwoven web 1 is guided through a narrow treatment gap or nip 9 between the upper treatment roller 3 and the lower treatment roller 3 of a treatment roller assembly 5. The treatment roller assembly 5 may be a calender roller assembly. Advantageously, at least one treatment roller 3 of this calender roller assembly or treatment roller assembly 5 is heated. The nonwoven web 1 is still guided over a deposition screen belt 10 on which it is formed upstream of this treatment roller assembly 5 in the travel direction. In order to prevent the adverse effects of air pulled along by the upper face of the nonwoven web 1, a stabilization plate 6 at a spacing a above the nonwoven web 1 is positioned immediately upstream of the treatment roller assembly 5.

In the embodiment according to FIG. 7, as well, a treatment roller assembly 5 is shown like that of FIG. 6. The nonwoven web 1 guided through the treatment gap 9 of the treatment roller assembly 5, is passed between upper and lower stabilization plates 6 immediately upstream of the treatment roller assembly 5. The stabilization plates 6 are each positioned at the spacing a above or below the nonwoven web 1. Adverse effects of the air entrained both on the upper face and on the lower face of the nonwoven web 1 can be effective prevented with this arrangement.

In the embodiment according to FIG. 8, the nonwoven web 1 is also guided through a treatment roller assembly 5 composed of two treatment rollers 3. The nonwoven web 1 that passes through the treatment gap 9 is guided past a stabilization plate 6 immediately upstream of the treatment roller assembly 5. The stabilization plate 6 is provided at the spacing a below the nonwoven web 1. Moreover, a flat deflection plate 7 above the nonwoven web 1 is provided immediately upstream of the treatment roller assembly 5 and above the stabilization plate such that this flat deflection plate 7 catches air entrained on the upper face of the nonwoven web 1 and deflects it away from the nonwoven web 1. For this purpose, the flat deflection plate 7 has a deflection tongue 8 set at a small spacing u from the upper nonwoven web face. The flat deflection plate 7 is bent upward starting from this deflection tongue 8. The deflection tongue 8 upwardly deflects air entrained on the upper face of the nonwoven web 1 via the arcuate shape of the flat deflection plate 7

We claim:

1. A method of guiding a nonwoven web made of continuous plastic fibers, the method comprising the steps of:

providing a nonwoven web having a web thickness less than 2 mm and a grammage less than 30 g/m$^2$;

conveying the web in a travel direction;

physically contacting the conveyed nonwoven web with a guide or treatment roller;

providing a stabilization plate extending in and transversely to the travel direction of the nonwoven web upstream or downstream of the roller in the travel direction, the stabilization plate having a substantially planar face turned toward and spaced wholly from the web to form an empty clearance gap between the web and the plate such that a cushion of air is created between the stabilization plate and the web to keep the web flat, the plate being of a length measured in the travel direction of the nonwoven web that is greater than a radius of the roller; and guiding the nonwoven web in the travel direction past the stabilization plate such that a spacing between a face of the stabilization plate turned toward the nonwoven web and the nonwoven web face is at most 20 mm.

2. The method defined in claim 1, wherein the conveyed nonwoven web is a spunbond or melt-blown web.

3. The method defined in claim 1, further comprising the step of:

providing an upstream conveyor section upstream of the roller;

providing a second stabilization plate at and spaced from the upstream conveyor section;

guiding the web upstream of the roller between the upstream conveyor section and the second stabilization plate.

4. The method defined in claim 1, further comprising the step of:

providing a downstream conveyor section downstream of the roller;

providing a second stabilization plate at and spaced from the downstream conveyor section;

guiding the web between the downstream conveyor section and the second stabilization plate.

5. The method defined in claim 1, wherein the stabilization plate is below the web, the method further comprising the step of:

maintaining a spacing between an upper face of the stabilization plate and a lower face of the nonwoven web.

6. The method defined in claim 1, wherein the stabilization plate is above the web, the method further comprising the step of:

maintaining a spacing between a lower face of the stabilization plate and an upper face of the nonwoven web.

7. The method defined in claim 1, further comprising the step of:

providing a deflection plate adjacent the web; and deflecting air entrained by the web away from the web.

8. The method defined in claim 1, wherein the nonwoven web is conveyed at a travel speed greater than 600 m/min.

9. The method defined in claim 1, wherein the nonwoven web is guided in a manner free of gas pressurization in the region of the stabilization plate.

10. The method defined in claim 1, wherein the roller is part of a roller assembly having two rollers forming a nip, the method further comprising the step of:

passing the web in the direction through the nip.

11. An apparatus for guiding a nonwoven web made of continuous plastic fibers and having a web thickness less than 2 mm and a grammage less than 30 g/m$^2$, the apparatus comprising a guide or treatment roller;

means for conveying the web in a travel direction and physically contacting the conveyed nonwoven web with the roller;

a stabilization plate extending in and transversely to the travel direction of the nonwoven web upstream or downstream of the roller in the travel direction, a face of the plate being planar, parallel to, and spaced transversely of the direction from the web by an empty clearance gap of at most 20 mm such that a cushion of air is created between the stabilization plate and the web to keep the web flat, the plate being spaced upstream or downstream from the roller in the travel direction by 0.2 mm to 500 mm, a length of the plate in the direction being greater than a radius of the roller.

12. The apparatus defined in claim 11, wherein the roller is part of a roller assembly having an upper and a lower roller and the means for conveying passes the web first over the upper roller and then under the lower roller.

13. The apparatus defined in claim 11, wherein the roller is part of a roller assembly having two rollers forming a nip and the means for conveying passes the web in the direction through the nip.

14. The apparatus defined in claim 11, wherein the stabilization plate is stationary.

15. The apparatus defined in claim 12, further comprising:

a deflection plate adjacent the web and oriented to deflect air entrained by the web away from the web.

* * * * *